US005288578A

United States Patent [19]

Sugizaki et al.

[11] Patent Number: 5,288,578

[45] Date of Patent: Feb. 22, 1994

[54] POSITIVELY CHARGEABLE CARRIER

[75] Inventors: Yutaka Sugizaki; Susumu Saito; Hirotaka Matsuoka; Masanori Ichimura; Masaru Miura; Takashi Imai, all of Minami Ashigara, Japan

[73] Assignee: Fuji Xerox Co., Ltd., Tokyo, Japan

[21] Appl. No.: 882,023

[22] Filed: May 13, 1992

[30] Foreign Application Priority Data

May 14, 1991 [JP] Japan ..... 3-137044

[51] Int. Cl.[5] ..... G03G 9/10

[52] U.S. Cl. ..... 430/108; 430/110

[58] Field of Search ..... 430/109, 108, 110

[56] References Cited

U.S. PATENT DOCUMENTS 4,954,409 9/1990 Aoki et al. ..... 430/108
4,965,159 10/1990 Kohno et al. ..... 430/108
4,977,054 12/1990 Honjo et al. ..... 430/108

FOREIGN PATENT DOCUMENTS 49-51950 5/1974 Japan .
57-99653 6/1982 Japan .
60-19156 1/1985 Japan .
60-202451 10/1985 Japan .
61-110159 5/1986 Japan .
61-110160 5/1986 Japan .
62-121463 6/1987 Japan .
1-29857 1/1989 Japan .
1-29860 1/1989 Japan .
1-35563 2/1989 Japan .
2-16573 1/1990 Japan .
2-24670 1/1990 Japan .

*Primary Examiner*—John Goodrow
*Attorney, Agent, or Firm*—Oliff & Berridge

[57] ABSTRACT

A positively chargeable carrier for developing electrostatic charge images having good surface staining resistance and good environmental reliance of charging is disclosed, which comprises a core material having formed thereon an interlayer having a triboelectrification controlling function and having a nitrogen atom content of from 5 ppm to 75 ppm based on the weight of the core material, and a releasable coated layer formed on the interlayer. A two-component developer using the carrier is also disclosed.

17 Claims, No Drawings

POSITIVELY CHARGEABLE CARRIER

FIELD OF THE INVENTION

The present invention relates to a positively chargeable carrier for developing electrostatic images, which is used for developing electrostatic latent images formed by an electrostatic recording method, and a two-component developer using the carrier.

BACKGROUND OF THE INVENTION

Hitherto, a carrier which is used for imparting a proper amount of a positive or negative electrostatic charge to toner particles in a magnetic brush developing process is generally classified into a coated series carrier and an uncoated series carrier but in the case of considering the life of the developer, the former is superior and hence the former carrier has been developed and practically used. In particular, in the case of a coated series carrier applied with a resin coating, the charge-controlling property is improved and also the environmental reliance and the stability with the passage of time are improved, whereby various resin-coated carriers have been developed.

However, the most troublesome problem in the case of using a two-component developer is that the charge-controlling property is deteriorated with the passage of time due to staining of the surface of the carrier with the binder resin, a charge-controlling agent, external additives, etc.

For preventing the occurrence of the surface stain of carriers, it has been proposed to use a fluorine series polymer and a silicone series polymer each having an excellent surface staining resistance and a low surface energy.

A fluorine series polymer has a low surface energy but has faults that a large amount of the polymer cannot be used for a negative charge imparting carrier owing to the high electric negativity of a fluorine atom which is a constituting component of the fluorine series polymer, and in particular, under high temperature and high humidity conditions, the charge imparting faculty is too reduced to use for practical purpose.

On the other hand, a silicone polymer has a low surface energy and is effective for preventing the occurrence of surface staining of a carrier as the fluorine series polymer but cannot completely prevent staining. Also, a silicone polymer is also positioned at the intermediate position of the triboelectrification series and it is hard to say that the polymer is sufficient for a negative charge imparting carrier In a carrier coated with a silicone polymer, raising the electrostatic charge is delayed under a low temperature and low humidity condition and in the case of newly adding toners, low-charged toners are liable to form, which results in causing fog and scattering of the toners.

Also, in these polymers, there are problems in the points of poor adhesion with the core materials of the carriers and the strength of the coating itself For overcoming the foregoing problems, use of an epoxy resin as an intermediate layer for improving a fluorine-containing polymer and a carrier core material is described in JP-A-49-51950 (the term "JP-A" as used herein means an "unexamined published Japanese patent application"). Further, it is proposed that the adhesion is improved by using a fluorine-series block copolymer and a graft copolymer, as described in JP-A57-99653 and JP-A-60-202451 and it is also proposed that the adhesion is improved by using a fluorine series polymer containing a hydrolyzable silyl group, as described in JP-A-2-16573 and JP-A-2-24670. In these cases, the adhesion is improved, but further improvements are yet required in the points that the carrier coated with the polymer has a low negative charge imparting faculty to toners and the environmental stability is insufficient.

Concerning the use of a silicone series polymer, it is proposed to use a coupling agent for improving the adhesion of the silicone resin coated layer, as described in JP-A-60-19156. The adhesion of the silicone resin coated layer is improved by this method. However, there is also a problem that the negative charge imparting faculty of the carrier to toners is insufficient though the fault is not so severe as the case of using the fluorine series polymer, and also the effect of preventing carrier surface staining is insufficient.

JP-A-62-121463 describes a carrier having a coated layer composed of a silicone resin formed on the surface of a carrier core treated with a silane coupling agent for improving the adhesion between the carrier core and the silicone resin. However, the coated layer composed of a silicone resin has such problems on production that nonuniform coating is formed and a high curing temperature is required.

Also, in JP-A-64-35563, JP-A-64-29857, and JP-A64-29860, there are described carriers each having a laminated layer structure but in the case of repeatedly using the carriers for a long period of time, there is a problem that each of the carriers cannot keep the electrostatically charging faculty.

Furthermore, for overcoming the foregoing problems, coated carriers each having laminated layers of a triboelectrification controlling layer and a releasable surface layer on the core material of the carrier are proposed in JP-A-61-110159 and JP-A-61-110160 and it is described therein that the carriers can stably impart negative charges to toners and can keep well the electrostatically charging faculty thereof However, in these carriers, there are such problems in practical use that the initial value electrostatic charging varies to a large extent and spreading of charge distribution occurs on toners.

SUMMARY OF THE INVENTION

The present invention has been made for solving the aforesaid problems in the conventional techniques.

An object of the present invention is, therefore, to provide a positively chargeable carrier for developing electrostatic images being used for magnetic brush development, said carrier having an excellent surface staining resistance, having a good environmental reliance of charging, showing a high raising speed of charging, and having an excellent charge exchanging property.

That is, a principal object of the present invention is to provide a carrier which shows a high raising speed of charging, is reluctant to cause staining of the carrier with toners or external additives even in the case of using a long period of time, and also is reluctant to cause lowering of the charging faculty.

Another object of this invention is to provide a carrier which does not cause a marked reduction of image density in part of images, etc., due to peeling off of the greater part of coated materials all at once.

Still another object of the present invention is to provide a carrier suitable for full color developers, wherein the consumed amount of toners is large and also the contact number of toners and the carrier is large.

As the result of various investigations for further improving the carrier described in the foregoing JP-A-61-110159, the inventors have discovered that the various characteristics of the carrier can be improved by forming a specific carrier structure using specific coating materials, and the inventors have succeeded in attaining the present invention based on the discovery.

It has now been found that the aforesaid objects of the present invention can be achieved by providing a triboelectrification controlling layer containing nitrogen atoms in a specific content range and a releasable coated layer, in sequence, on a carrier core material.

That is, according to the present invention, there is provided a positively chargeable carrier for developing electrostatic images, comprising an interlayer having a triboelectrification controlling function formed on a carrier core and a releasable coated layer containing a fluorine series resin formed on the interlayer.

The foregoing carrier of the present invention is used as a two-component developer for developing electrostatic images.

The nitrogen atom content in the interlayer is from 5 ppm to 75 ppm based on the weight of the carrier core. In particular, the carrier of the present invention has a coated layer containing a fluorine series resin on the interlayer as the feature of this invention.

DETAILED DESCRIPTION OF THE INVENTION

The positively chargeable carrier for developing electrostatic images of this invention (hereinafter, referred to simply as the carrier or the carrier of this invention) has coated layers of a double layer structure composed of an intermediate layer having a triboelectrification controlling function and a releasable coated layer.

For the interlayer, a material having a property of imparting a negative charge to toners is used, and an amino group-containing silane coupling agent is preferably used. In this case, the silane coupling agent which is not substantially dissolved in an organic solvent being used for forming the releasable coated layer is preferred. Practically, a tri-functional nitrogen-containing silane coupling agent which becomes insoluble in the organic solvent by forming a three-dimensional network structure by a dehydrocondensation reaction is suitable. Preferred examples thereof are as follows $NH_2CH_2CH_2CH_2SI(OR)_3$ $NH_2CONHCH_2CH_2CH_2Si(OR)_3$ $NH_2CH_2CH_2NHCH_2CH_2CH_2Si(OR)_3$ $C_6H_5NHC_3H_6Si(OR)_3$ wherein the plurality of R in each formula may be the same or different and each represents a methyl group or an ethyl group.

The interlayer can be formed on the carrier core by the following manner For example, an amino group-containing silane coupling agent as an interlayer-forming material is dissolved in an alcoholic solvent such as methanol and the solution is mixed with a core material such as ferrite particles and a pure water at room temperature. After removing the alcoholic solvent with heating under reduced pressure, the resulting mixture is heated at a predetermined temperature to conduct a coupling reaction The heating temperature should not be higher than the temperature at which decomposition of the amino group takes place, and the reaction is generally carried out at a temperature of about 120° C. or less, preferably from 100 to 120° C., for 2 to 3 hours. The reaction time is preferably selected in such a manner that the time is to be in inverse proportion to the reaction temperature. When heated so, a hydrodecomposition reaction between the amino-containing silane coupling agent and water takes place to convert the amino group into a hydroxy group which undergoes a dehydrocondensation reaction with a hydroxy group present on the ferrite particles, whereby the silane coupling agent is chemically bonded to the ferrite particles. At the same time, the hydroxy groups of the silane coupling agent themselves undergo a dehydrocondensation reaction, so that an interlayer having a three-dimensional network structure of the coupling agent is formed on the ferrite particles.

The interlayer having a triboelectrification function is formed such that the nitrogen atom content thereof is from 5 ppm to 75 ppm, preferably from 10 ppm to 50 ppm based on the weight of the core material. The nitrogen atom content can be adjusted by properly selecting the coating amount of an interlayer-forming material and the heating condition in the formation of an interlayer as described above. When the nitrogen atom content in the interlayer is within the foregoing range, the carrier becomes excellent in environmental stability, the carrier is less influenced by the characteristics of the releasable coated layer which is the uppermost layer, and the carrier can stably impart a negative charge to toners. Furthermore, by using a large amount of the fluorine-containing polymer for the releasable coated layer, the carrier can impart a sufficient negative charge to toners.

In addition, as a measurement method for a nitrogen atom content, an organic elemental analysis is suitable. As an apparatus being used for the organic elemental analysis, a chemiluminescence type total nitrogen analyzer can be used in the case of measuring the content of nitrogen atoms only. Also, as other apparatus, an oxygen circulating combustion system nitrogen carbon analyzer, etc., can be used, such as a high sensitive NC-analyzer Sumigraph NC-90A, manufactured by Sumika Bunseki Center K.K.

For the coated layer to be formed on the interlayer, a fluorinated alkyl acrylate or methacrylate (collectively referred to as "(meth)acrylate") homopolymer or copolymer, a silicone series polymer, and polyolefins such as polyethylene, polypropylene, etc., can be used. As the structure of the fluorinated alkyl (meth)acrylate copolymer, a graft or block structure is preferred since the adhesion and the releasable property can be more precisely controlled. For controlling the adhesion with the interlayer and the releasable property of the surface layer, the foregoing material may be used with other resins For example, in the case of using a fluorinated alkyl (meth)acrylate copolymer, it is preferred to use the copolymer in a state of a polymer blend thereof with other acrylic or methacrylic polymers, a styrene-(meth-)acrylic copolymer, etc. which contain as a monomer component a (meth)acrylic acid, a (meth)acrylic acid ester, a styrenic monomer or the like.

The monomer content of the fluorinated alkyl (meth-)acrylate in the fluorinated alkyl (meth)acrylate copolymer is preferably from 30 to 60% by weight and in the case of using a blend of the fluorinated alkyl (meth)acrylate copolymer and other polymers, the mixing ratio of the copolymer is suitably from 40 to 70% by weight.

As the fluorinated alkyl acrylate or the fluorinated alkyl methacrylate constituting the fluorinated alkyl (meth)acrylate copolymer, the following monomers can be used: ester compounds such as a 1,1-dihydroxyperfluoroethyl ester, a 1,1-dihydroperfluoropropyl ester, a 1,1-dihydroperfluorohexyl ester, a 1,1-dihydroperfluorooctyl ester, a 1,1-dihydroperfluorodecyl ester, a 1,1-dihydroperfluorolauryl ester, a 1,1,2,2-tetrahydroperfluorobutyl ester, a 1,1,2,2-tetrahydroperfluorooctyl ester, a 1,1,2,2-tetrahydroperfluorodecyl ester, a 1,1,2,2-dihydroperfluorolauryl ester, a 1,1,2,2-dihydroperfluorostearyl ester, a 2,2,3,3-tetrafluoropropyl ester, a 2,2,3,3,4,4-hexafluorobutyl ester, a 1,1,ω-trihydroperfluorohexyl ester, a 1,1,ω-trihydroperfluorooctyl ester, a 1,1,1,3,3,3-hexafluoro-2-chloropropyl ester, a 3-perfluorononyl-2-acetylpropyl ester, a 3-perfluorolauryl-2-acetylpropyl ester, an N-perfluorohexylsulfonyl-N-methylaminoethyl ester, an N-perfluorosulfonyl-N-butylaminoethyl ester, an N-perfluorooctylsulfonyl-N-methylaminoethyl ester, an N-perfluorooctylsulfonyl-N-ethylaminoethyl ester, an N-perfluorooctylsulfonyl-N-butylaminoethyl ester, an N-perfluorodecyl sulfonyl-N-methylaminoethyl, an N-perflurodecylsulfonyl-N-ethylaminoethyl ester, an N-perfluorodecylsulfonyl-N-butylaminoethyl ester, an N-perfluorolaurylsulfonyl-N-methylaminoethyl ester, an N-perfluorolaurylsulfonyl-N-ethylaminoethyl ester, an N-perfluorolaurylsulfonyl-N-butylaminoethyl ester, etc., of acrylic acid or methacrylic acid.

As a monomer component which is copolymerized with the fluorinated alkyl acrylate or the fluorinated alkyl methacrylate, the following monomers can be used: styrene; alkyl styrenes such as methylstyrene, dimethylstyrene, trimethylstyrene, ethylstyrene, diethylstyrene, triethylstyrene, propylstyrene, butylstyrene, hexylstyrene, heptylstyrene, octylstyrene, etc.; halogenated styrenes such as fluorostyrene, chlorostyrene, bromostyrene, dibromostyrene, iodostyrene, etc.; styrenic monomers such as nitrostyrene, acetylstyrene, methoxystyrene, etc.; addition polymerizable unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid, angelic acid, etc.; addition polymerizable unsaturated aliphatic dicarboxylic acids such as maleic acid, fumaric acid, itaconic acid, citraconic acid, mesaconic acid, glutaconic acid, dihydromuconic acid, etc.; ester compounds of the foregoing addition polymerizable unsaturated carboxylic acids and alcohols, for example, ester compounds of the unsaturated carboxylic acids and alkyl alcohols such as methanol, ethanol, propanol, butanol, amyl alcohol, hexyl alcohol, heptyl alcohol, octyl alcohol, nonyl alcohol, dodecyl alcohol, tetradecyl alcohol, hexadecyl alcohol, etc., alkoxyalkyl alcohols formed by partially alkoxylating these alkyl alcohols, such as methoxyethyl alcohol, ethoxyethyl alcohol, ethoxyethoxyethyl alcohol, methoxypropyl alcohol, ethoxypropyl alcohol, etc., aralkyl alcohols such as benzyl alcohol, phenylethyl alcohol, phenylpropyl alcohol, etc., or alkenyl alcohols such as allyl alcohol, crotonyl alcohol, etc., and preferably an acrylic acid alkyl ester, methacrylic acid alkyl ester (excluding methyl methacrylate), fumaric acid alkyl ester, maleic acid alkyl ester, etc.; the amines and nitriles derived from the foregoing addition polymerizable unsaturated carboxylic acids; aliphatic monoolefins such as ethylene, propylene, butene, isobutyrene, etc.; halogenated fatty acid olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, vinylidene fluoride, etc.; conjugated aliphatic diolefins such as 1,3-butadiene, 1,3-pentadiene, 2-methyl-1,3-butadiene, 2,3-dimethyl-1,3-butadiene, 2,3-hexadiene, 3-methyl-2,4-hexadiene, etc.; and nitrogen-containing vinylic monomers such as 2-vinylpyridine, 4-vinylpyridine, 2-vinyl-6-methylpyridine, 2-vinyl-5-methylpyridine, 2-vinyl-5-methylpyridine, 4-4-pentylpyridine, N-vinylpiperidine, 4vinylpiperidine, N-vinyldihydropyridine, N-vinylpyrrole, 2-vinylpyrrole, N-vinylpilosine, N-vinylpyrrolidine, 2-vinylpyrrolidine, N-vinyl-2-pyrrolidone, N-vinyl-2piperidone, N-vinylcarbazole, etc. They can be used singly or as a combination thereof.

As the core material which can be used in this invention, there are a powder of a magnetic metal such as iron, steel, nickel, cobalt, etc., and a powder of a magnetic oxide such as magnetite, ferrite, etc., each having a mean particle size of from 10 μm to 150 μm.

The coating amount of the foregoing releasable resin is from 0.1 to 5.0% by weight, and preferably from 0.5 to 1.0% by weight based on the amount of the core material.

The foregoing carrier of this invention is used for a two-component developer for developing electrostatic charge images by combining with toners composed of a binder resin having dispersed therein a coloring agent and it is preferred that the carrier is used for developers for full color images of high image quality.

Then, toners are explained. As the binder resin for toners for full color images of a high image quality, it is preferred to use a polyester resin having a softening point by a ball and ring method of from 100° C. to 120° C., preferably from 100° C. to 115° C., a glass transition point of at least 55° C., a Gardner color number of 2 or less, a haze value of 15 or less, and containing a diol component represented by following formula (I) as a necessary component:

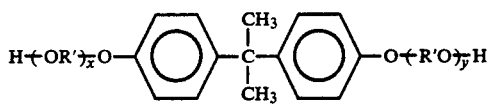

(I)

wherein R′ represents an ethylene group or a propylene group and x and y each represents an integer of at least 1, provided that the sum of x and y is from 2 to 6.

As the alcohol component of the polyester resin, ethylene glycol, propylene glycol, 1,3-butanediol, 1,4butanediol, 2,3-butanediol, diethylene glycol, 1,5pentanediol, 1,6-hexanediol, neopentyl glycol, bisphenol A, cyclohexane dimethanol, etc., can be used together with the foregoing diol component.

Examples of an acid component of the polyester resin include a dicarboxylic acid such as terephthalic acid, isophthalic acid, fumaric acid, succinic acid, adipic acid, sebacic acid, etc., is used. A tricarboxylic acid such as trimellitic acid, pyromellitic acid, and the acid anhydrides thereof can be used together.

As pigments which are used for the toners, organic pigments such as C.I. pigment red 57:1, 64:1, 81, 83, 114, 112, 122, 146, 170, and 185; C.I. pigment blue 15:3, 17:1, 1, 15, and 2, C.I. pigment yellow 12, 13, 17, 97, 1, 3, 55, 74, 81, 83, and 120, and other organic pigments being used for a printing ink, etc. can be used.

The average particle size of the foregoing toners is preferably in the range of 5 to 9 μm. Using the toner having the size within the above range, a full color image having fine image quality can be obtained.

Titania fine particles rendered hydrophobic and having an average particle size of from 10 nm to 20 nm and silica fine particles rendered hydrophobic and having a mean particle size of from 20 nm to 80 nm may be added to the toner as external additives. In this case, it is preferred that at least one of titania and silica is rendered hydrophobic by the treatment with a silane coupling agent containing an amino group. The addition ratio of titania fine particles rendered hydrophobic to the toner particles is preferably from 30 to 200% as a coating ratio. Also, the addition ratio of silica fine particles rendered hydrophobic to the toner particles is preferably from 10 to 200% as a coating ratio. The coating ratio herein used is the value calculated by the following equation. In the calculation, the specific gravity of a polyester toner is defined as 1.1, the specific gravity of amorphous titania 3.0, and the specific gravity of silica 2.2.

$$f = \frac{\sqrt{3}}{2\pi} \cdot \frac{d_t p_t}{d_A p_A} \cdot C$$

Wherein $d_t$ is the mean particle size of the toner, $p_t$ is the specific gravity of the toner, $d_A$ is the average particle size of external additive A, $p_A$ is the specific gravity of external additive A, and C is the weight ratio of external additive/toner.

As the silane coupling agent containing an amino group for rendering the external additive hydrophobic, the materials described above can be used.

By adding amorphous titania fine particles rendered hydrophobic and having the mean particle size of from 10 to 20 μm to the toner powder at the foregoing coating ratio, the powder fluidity of the toner powder is improved, and also by adding silica fine particles rendered hydrophobic and having an average particle size of from 20 to 80 μm to the toner powder at the foregoing coating ratio, the adhesive power of the toner powder property of the toner fine particles (5 to 9 μm) can be improved.

Then, the present invention is described practically by the following examples, wherein the parts, ratios and percents are by weight unless otherwise indicated.

EXAMPLE 1

| Interlayer | |
|---|---|
| Spherical Ferrite Particles of Mean Particle Size of 50 μm | 100 parts |
| Methanol | 14 parts |
| γ-Aminopropyltriethoxysilane | 0.05 part |
| Pure Water | 0.05 part |

The foregoing components were placed in a vacuum degassing type kneader, after stirring the mixture for 30 minutes at room temperature, methanol was distilled off by heating under reduced pressure, and a coupling reaction was carried out for 30 minutes at 100° C. to provide spherical ferrite particles treated with γ-aminopropyltriethoxysilane. (Carrier a)

| Resin Layer | |
|---|---|
| Foregoing Spherical Ferrite Particles | 100 parts |
| Xylene | 10 parts |
| Styrene/Methyl Methacrylate (20/80) Copolymer | 0.25 part |
| N-Perfluorohexylsulfonyl-N-methyl-aminoethyl Methacrylate/Methyl Methacrylate (40/60) Copolymer | 0.25 part |

The foregoing components were placed in a vacuum degassing type kneader, xylene was distilled off by gradually reducing the pressure in the kneader, and the residue was sieved with 74 μm mesh sieve to provide a resin-coated carrier. (Carrier A)

EXAMPLE 2

By following the same procedure as Example 1 except that 0.05 part of Y-aminopropyltriethoxysilane was changed to 0.075 part of the silane, carriers were obtained. (Carrier b and Carrier B) (Herein, the carrier designated with a small letter being a carrier having only the interlayer and the carrier designated with a capital letter (except carrier E) being a carrier having both the interlayer and the resin layer.)

EXAMPLE 3

By following the same procedure as Example 1 except that 0.05 part of γ-aminopropyltriethoxysilane was changed to 0.10 part of the silane, carriers were obtained. (Carrier c and Carrier C)

COMPARISON EXAMPLE 1

By following the same procedure as Example 1 except that 0.05 part of γ-aminopropyltriethoxysilane was changed to 0.20 part of the silane, carriers were obtained. (Carrier d and Carrier D)

COMPARISON EXAMPLE 2

By following the same procedure as Example 1 except that the treatment with γ-aminopropyltriethoxysilane was omitted, a carrier was obtained (Carrier E)

REFERENCE EXAMPLE

| | |
|---|---|
| Carrier a | 100 parts |
| Xylene | 10 parts |
| Styrene/Methyl Methacrylate (20/80) Copolymer | 0.5 part |

The foregoing components were placed in a vacuum degassing type kneader and thereafter by following the same manner as in Example 1, a carrier was prepared Carrier F In each of the carriers obtained in Examples 1 to 3, Comparison Examples 1 and 2, and Reference Example described above, the measurement of the nitrogen content of each interlayer was carried out using an oxygen circulating burning system high sensitive NC-Analyzer, Sumigraph NC-90A (trade name, made by Sumika Bunseki Center K.K.). the results obtained are shown in Table 1 below.

As a standard sample for making a calibration curve, an aqueous solution of glycine (guaranteed reagent) was prepared and the measurement was carried out by a two-point calibration curve method of total nitrogen amount = 50 ppm and total carbon amount = 85.7 ppm, and total nitrogen amount = 1000 ppm and total carbon amount = 17 ppm.

Each sample (about 500 mg) was placed on a quartz boat and measured by means of a semi-micro balance having a reciprocal sensibility of 0.01 mg.

TABLE 1

| | Carrier a | | Carrier b | | Carrier c | | Carrier d | | Untreated Ferrite | |
|---|---|---|---|---|---|---|---|---|---|---|
| Run No. | TN | TC | TN | TC | TN | TC | TN | TC | TN | TC |
| 1 | 20 | 77 | 35 | 122 | 50 | 155 | 90 | 300 | ≦5 | 15 |
| 2 | 20 | 78 | 35 | 122 | 50 | 153 | 90 | 300 | ≦5 | 15 |
| 3 | 20 | 76 | 35 | 121 | 50 | 154 | 91 | 302 | ≦5 | 16 |
| Mean Value | 20 | 77 | 35 | 122 | 50 | 154 | 90 | 301 | ≦5 | 15 |
| [Mean Value]-[Untreated Ferrite] | ≧15 | 62 | ≧30 | 107 | ≧45 | 140 | ≧85 | 296 | | |

[Note]
TN: Total nitrogen amount (ppm) in the interlayer based on the weight of the core material
TC: Totqal carbon amount (ppm) in the interlayer based on the weight of the core material

Production Example of Toner

| Toner A: | |
|---|---|
| Polyester resin composed of bisphenol A-propylene oxide adduct, cyclohexane dimethanol, and terephthalic acid (Tg = 16° C., softening point = 105° C., acid value = 6, hydroxy group value = 20) | 100 parts |
| Carmin 6BC | 4 parts |

After mixing the foregoing components, the mixture was kneaded by means of an extruder, and after cooling, the kneaded mixture was coarsely ground by means of a hammer mill. Then, the coarse particles were finely ground by means of an air jet type fine grinder followed by classifying to provide toner particles having a mean particle size of 7 μm. The toner particles were mixed with amorphous titania fine particles rendered hydrophobic (mean particle size 15 nm, made by Idemitu Kosan Co., Ltd.) in an amount corresponding to 40% in coating ratio and silica fine particles rendered hydrophobic (mean particle size 40 nm, OX-50, trade name, made by Nippon Aerosil K.K.) in an amount corresponding to 15% in coating ratio using a Henschel mixer.

The treatment methods for rendering amorphous titania and OX-50 hydrophobic were as follows.

Treatment of OX-50

After dispersing 100 g of the fine particles of OX-50 in 500 g of methanol, a mixture of 10 g of hexamethylsilazane and 0.3 g of γ-aminotriethoxysilane was added dropwise to the dispersion, which was then stirred for one hour, followed by filtration. After drying the thus obtained particles for 5 hours at 120° C., the dried residue was ground by a pin mill.

Treatment of Amorphous Titania 100 g of the fine particles of amorphous titania were treated by the same manner as the foregoing treatment for the OX-50 fine particles except that γ-aminotriethoxysilane was not added.

Preparation of Developers

By mixing 100 parts by weight of each of the carriers obtained in foregoing Examples 1 to 3, Comparison Examples 1 and 2, and Reference Example, with 8 parts by weight of toner A, 6 kinds of two-component developers were prepared By using each of these developers using each of the carriers (Carriers A to F) obtained above, a copy test was carried out by an electrophotographic copying apparatus (modified apparatus of FX-5030, trade name, manufactured by Fuji Xerox Co., Ltd.). After copying 100 copies under a high-temperature, high-humidity (30° C., 85% RH) circumstance and a low-temperature, low-humidity (10° C., 15% RH) circumstance, the charged amount, the image density, and the fog were evaluated. The results are shown in Table 2 below.

In the Table 2 below, as to fog, ○ means that no fog formed, and x means that fog formed greatly.

TABLE 2

| | High Temperature High Humidity | | | Low Temperature Low Humidity | | |
|---|---|---|---|---|---|---|
| Carrier | (C.A.)* (μC/g) | (I.D.)** | Fog | (C.A.) (μC/g) | (I.D.) | Fog |
| Carrier A | −12.5 | 1.45 | ○ | −16.5 | 1.40 | ○ |
| Carrier B | −13.8 | 1.50 | ○ | −18.0 | 1.38 | ○ |
| Carrier C | −15.0 | 1.43 | ○ | −23.2 | 1.30 | ○ |
| Carrier D | −18.6 | 1.40 | ○ | −30.0 | 1.10 | X |
| Carrier E | −7.8 | 1.50 | ○ | −13.0 | 1.46 | ○ |
| Carrier F | −13.0 | 1.46 | ○ | −17.2 | 1.4 | ○ |

*: Charged Amount
**: Image Density
(Note):
Carrier D shows too high charging property.
Carrier E shows too low charging property.
Carrier F shows a good charging property but the life is short.

As shown in Table 2, in the case of using carrier D, under a low-temperature and low-humidity circumstance, the image density was reduced since the charged amount of the toner was high.

In Table 2, the ratios of the total nitrogen amount/the total carbon amount are lower than values calculated from the supplied amounts, and it is assumed that this is because of the loss of the coating solution at coating or the reduction of the nitrogen content due to partial cutting of the $CH_2$–$NH_3$ bond at the dehydrocondensation upon heating of the coupling agent.

Using each of the carriers (Carriers A, B, C, E and F) obtained in Examples 1 to 3 and Comparison Example 2 and Reference Example, continuous copying of 40,000 copies was made at normal temperature and normal humidity (22° C., 50% RH) using the modified apparatus of FX-5030. The results obtained are shown in Table 3 below.

TABLE 3

| Carrier | Beginning (C.A.)* (μC/g) | Beginning (P)** (wt %) | After copying 10,000 Copies (C.A.) (μC/g) | After copying 10,000 Copies (P) (wt %) | After copying 40,000 Copies (C.A.) (μC/g) | After copying 40,000 Copies (P) (wt %) |
|---|---|---|---|---|---|---|
| Carrier A | −14.0 | 0 | −12.5 | 0 | −9.0 | 1 |
| Carrier B | −15.5 | 0 | −13.6 | 0 | −10.5 | 0 |
| Carrier C | −18.8 | 0 | −15.6 | 0 | −12.3 | 0 |
| Carrier E | −11.9 | 0 | −9.0 | 2 | −5.2 | 21 |
| Carrier F | −14.2 | 0 | −6.0 | 15 | −3.0 | 30 |

*: Charged Amount
**: Amount of Opposite-Polarity Toner
(Note):
Carrier F shows a good charging property but the life is short.

As shown in Table 3, in the case of using the developers using Carriers A, B, and C, respectively, negatively chargeable toners having the opposite polarity (i.e., positive charge) (hereafter referred to as "opposite-polarity toners") were scarcely generated from the beginning of copying, and images having no background fog, having a high density, and having a good image quality were obtained On the other hand, in the case of using the developer using Carrier E, images having a good image quality were obtained at the beginning but after copying 40,000 copies, the opposite-polarity toners were increased and the formation of background fog was observed Also, in the case of the developer using Carrier F, the foregoing tendency was remarkable, and after copying 10,000 copies, the formation of background fog was observed The charged amount and the amount of opposite-polarity toners given in Tables 2 and 3 are the values obtained by the image analysis of CSG.

As described hereinabove, since the positively chargeable carrier of the present invention has the aforesaid structure, even in the case of repeated use thereof for a long period of time, the carrier exhibits a high positively charged amount and has a long life. Furthermore, the uppermost surface of the carrier of the present invention is composed of a fluorine series resin having a releasable property, the change of the charging property by staining with toners and external additives scarcely occurs, and stains of the inside of a copying apparatus scarcely occur. Also, the developer using the carrier of the present invention shows less formation of opposite-polarity toners, and even after repeated use for a long period of time, the formation of opposite-polarity toners can be kept at a low rate. Accordingly, with the developer of the present invention, copied images of a high image quality without having background stains and image disturbance can be obtained for a long period of time.

While the invention has been described in detail and with reference to specific embodiments thereof, it will be apparent to one skilled in the art that various changes and modifications can be made therein without departing from the spirit and scope thereof.

What is claimed is:

1. A positively chargeable carrier for developing electrostatic images, comprising a core material having formed thereon an interlayer having a triboelectrification controlling function and having a nitrogen atom content of from 5 ppm to 75 ppm based on the weight of the core material, and a releasable coated layer formed on the interlayer, wherein the releasable coated layer is present on the interlayer in a coating amount sufficient to cause the carrier to impart a sufficient negative charge to toners.

2. The positively chargeable carrier as claimed in claim 1, wherein said releasable coated layer contains a fluorine series resin.

3. The positively chargeable carrier as claimed in claim 2, wherein the interlayer formed on the core material comprises a silane coupling agent containing nitrogen atoms.

4. The positively chargeable carrier as claimed in claim 3, wherein the silane coupling agent containing nitrogen atom is a silane coupling agent containing an amino group.

5. The positively chargeable carrier as claimed in claim 3, wherein the silane coupling agent containing nitrogen atom is a tri-functional nitrogen-containing silane coupling agent.

6. The positively chargeable carrier as claimed in claim 2, wherein the fluorine series resin is a homopolymer of a fluorinated alkyl (meth)acrylate, or a copolymer of a fluorinated alkyl (meth)acrylate and other monomer.

7. The positively chargeable carrier as claimed in claim 6, wherein the copolymer of the fluorinated alkyl (meth)acrylate and other monomer has a copolymerization ratio of the fluorinated alkyl (meth)acrylate to other monomer in the range of from 3:7 to 6:4.

8. The positively chargeable carrier as claimed in claim 1, wherein the releasable coated layer comprises a fluorine series resin and other resin.

9. The positively chargeable carrier as claimed in claim 8, wherein the content of the fluorine series resin in the releasable coated layer is from 40 to 70% by weight.

10. The positively chargeable carrier as claimed in claim 8, wherein the other resin is a polymer or a copolymer of at least one of a (meth)acrylic acid monomer, a (meth)acrylic acid ester series monomer, and a styrenic monomer.

11. The positively chargeable carrier as claimed in claim 1, wherein the coating amount of the releasable coated layer is from 0.5 to 1.0% by weight based on the weight of the core material.

12. A two-component developer for developing electrostatic images, comprising a positively chargeable carrier and a toner, said positively chargeable carrier comprising a core material having formed thereon an interlayer having a triboelectrification controlling function and having a nitrogen atom content of from 5 ppm to 75 ppm based on the weight of the core material, and a releasable coated layer formed on the interlayer, wherein the releasable coated layer is present on the interlayer in a coating amount sufficient to cause the carrier to impart a sufficient negative charge to toners.

13. The two-component developer as claimed in claim 12, wherein the releasable coated layer contains a fluorine series resin, 14. The positively chargeable carrier as claimed in claim 1, wherein the coating amount of the releasable coated layer is at least 0.1% by weight based on the weight of the core material.

15. The positively chargeable carrier as claimed in claim 1, wherein the coating amount of the releasable coated layer is at least 0.5% by weight based on the weight of the core material.

16. The two-component developer as claimed in claim 12, wherein the coating amount of the releasable coated layer is at least 0.1% by weight based on the weight of the core material.

17. The two-component developer as claimed in claim 12, wherein the coating amount of the releasable coated layer is at least 0.5% by weight based on the weight of the core material.

* * * * *